United States Patent [19]

Atkinson et al.

[11] Patent Number: 4,934,295

[45] Date of Patent: Jun. 19, 1990

[54] SAILING VESSEL

[76] Inventors: Christopher Atkinson, 9625 Second Street, Sidney, B.C., Canada, V8L 3C3; Peter C. Sewell, 4490 Blenheim Street, Vancouver, B.C., Canada, V6L 2Z9; Karl L. Hamson, Hoosen Road, R.R. 1, Pender Island, B.C., Canada, V0N 2M0

[21] Appl. No.: 130,137

[22] Filed: Dec. 8, 1987

[30] Foreign Application Priority Data

Dec. 8, 1986 [CA] Canada ..... 524789
Aug. 20, 1987 [CA] Canada ..... 545017

[51] Int. Cl.[5] ..... B63H 9/08

[52] U.S. Cl. ..... 114/39.1; 114/91; 114/106

[58] Field of Search ..... 114/39.1, 89, 90, 91, 114/92, 93, 102, 103, 104, 105, 106, 107, 97

[56] References Cited

U.S. PATENT DOCUMENTS

| | | | |
|---|---|---|---|
| 35,882 | 7/1862 | May . | |
| 559,718 | 5/1896 | King | 114/97 |
| 792,924 | 6/1905 | Posgate . | |
| 1,039,122 | 9/1912 | Hagborg | 114/90 |
| 1,375,400 | 4/1921 | Ljungstrom | 114/91 |
| 3,085,539 | 4/1963 | Prolss | 114/91 |
| 3,142,282 | 7/1964 | Nichols . | |
| 3,157,148 | 11/1964 | Reed | 114/90 |
| 4,248,281 | 2/1981 | Hood | 114/106 |
| 4,259,917 | 4/1981 | Frank . | |

FOREIGN PATENT DOCUMENTS

| | | | |
|---|---|---|---|
| 8600661 | 10/1987 | Netherlands | 114/91 |

OTHER PUBLICATIONS

Article entitled "The Bi-Pole Rig" published in China.
Advertisement entitled "Spar Adjustable Outboard Motor Bracket" obtained with product, Sep. 1982.
Article entitled "An Interview with Garry Hoyt", *Yacht Racing & Cruising* (Jan. 1986 issue).
Photograph of Sailing Vessel, Jul. 1985 edition of *Pacific Yachting.*

*Primary Examiner*—Sherman D. Basinger
*Assistant Examiner*—Stephen P. Avila
*Attorney, Agent, or Firm*—John R. Uren

[57] ABSTRACT

A sailing boat with an A-shaped mast pivotally connected to the topside of the cabin and sloping forwardly from the connection points. A backstay holds the mast in its inclined operating position. The jib and the mainsail are furling sails and are attached to forestays connected between the forward portion of the vessel and the mast.

14 Claims, 6 Drawing Sheets

SAILING VESSEL

INTRODUCTION

This invention relates to a sailing boat and, more particularly, to a sailing boat utilizing an A-frame type mast which is pivotally connected to the cabin of the boat.

BRACKGROUND OF THE INVENTION

The great majority of conventional sailing vessels have a single mast which extends up the forward side of the mainsail substantially midway of the length of the boat. A forestay runs from the top of the mast to the bow of the boat and the jib runs aft of the forestay. Both the jib and the mainsail extend from the deck or cabin top to the masthead.

Such a conventional vessel, however, suffers certain disadvantages inherent in the design. One disadvantage is that because the mast is located on the luff or forward side of the mainsail, the airflow over the mainsail is disrupted which reduces the efficiency of the said and, therefore, unnecessarily reduces the speed of the boat. A further disadvantage lies in the structure of the mast itself which, because of the large side loading in addition to the compression loading caused by the wind loading on the sails, can break and result in dismasting of the vessel. Yet a further disadvantage results from the use of the stays which extend from the top to the mast to the gunwales on opposite sides of the boat. These stays can cause damage to a jib or genoa and interfere with access and vessel operation. Yet a further disadvantage is that the mainmast on a conventional vessel is difficult to remove even where design efforts have been directed towards facilitating that operation. When the mast is eventually removed, it will ordinarily extend along the longitudinal axis of the boat which makes access to the cabin difficult. The raising and lowering operation, further, is also time consuming and tedious. Such boats, therefore, are also inherently troublesome when used in trailer boating.

Yet a further disadvantage with conventional sailing vessels relates to the lack of convenient adjustment of the angle of the mast for various wind and sea conditions. It is known that the most efficient mast position for maximum performance and stability varies according to these conditions and most conventional sailing vessels lack any convenient adjustment to compensate for or to take advantage of such changing conditions.

Present mounting for outboard engines in sailing vessels or powerboats comprises, generally, two principal methods. A first method teaches mounting the motor in a well within the vessel. This method requires a hole to be cut in the hull into which the motor is mounted. The disadvantages inherent in such mounting are clear and include the loss of interior space in the vessel, the objectional and dangerous concentration of engine fumes in the cockpit, the reduced performance of the vessel under sail because of the drag caused by the well mounted engine and the fact that the engine must be removed from the well to beach or trailer the boat.

A second method teaches mounting the engine on a vertically sliding or cantilever type bracket on the transom, the bracket being mounted so as to provide sufficient space to allow for kick-up of the engine without striking the transom if an obstacle or foreign debris is encountered. It is difficult to mount the engine in the centre of the transom on a sailing vessel, however, which is desirable for static and dynamic balance of the vessel, because of the resulting interference with the rudder assembly. Side mounting of the engine can result in immersion of the engine because a sailing vessel can heel well up to forty-five (45) degrees in operation. Such potential immersion creates the necessity to raise the engine under sail which can be tedious, difficult and dangerous.

A further type of engine mount used on powerboats teaches a centrally mounted bracket which may or may not be vertically slidable and which provides a variable tilt angle to the engine for raising the motor from the water when desired and for trimming the tilt angle when the motor is operating for maximum efficiency. Such an engine mount, however, requires the engine to be mounted closely adjacent to the transom of the vessel which requires the propellor to operate in water which contains air bubbles leading to propellor cavitation and consequent loss of performance from the vessel.

Yet a further type of engine mount is a cantilever type bracket extending rearwardly from the vessel with the motor mounted to the end of the bracket. Such a bracket allows the engine to be moved rearwardly to a position where there are fewer air bubbles in the water but access to the engine is difficult because of its distance from the boat and there is, of course, no adjustment available in the longitudinal distance between the engine and the transom.

SUMMARY OF THE INVENTION

According to one aspect of the invention, there is disclosed an A-frame masted sailing boat comprising a hull, a cabin located on said hull, a mast having two legs, each leg extending from a pivotal connection stepped at opposite sides of the topside of said cabin and joining with the opposite leg of said mast at an apex, said mast being operable to slope forwardly from said pivotal connections to said apex, and at least one backstay operable to extend from the aft portion of said mast to the stern of said boat.

According to a further aspect of the invention, there is disclosed a motor mount comprising a bracket operable to be attached to a transom, link means pivotably connected to said bracket, a motor clamping block pivotably connected to said link means and adjustment means operable to rotate said link means and said clamping block about said bracket.

According to yet a further aspect of the invention, there is provided a motor mount comprising sleeve means to allow rotation of a motor about a first generally horizontal axis and about a first generally vertical axis, rudder means operable to be connected to the transom of a boat to pivot about a second generally vertical axis and movement means operable by said rudder means to rotate said motor about said first generally vertical axis simultaneously with and in the same direction as the movement of said rudder means about said second generally vertical axis.

According to a further aspect of the invention, there is provided a motor mount comprising link means operable to be connected to the transom of a boat and to rotate about a generally horizontal first axis, said link means extending outwardly from said transom to a motor holding bracket rotatably mounted about a second generally horizontal axis on the distaff end of said link means, cable means operably connected between a pulley mounted on said boat and said motor holding bracket, said cable being operable to lift or lower said motor holding bracket and said link means about said generally horizontal first and second axes.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
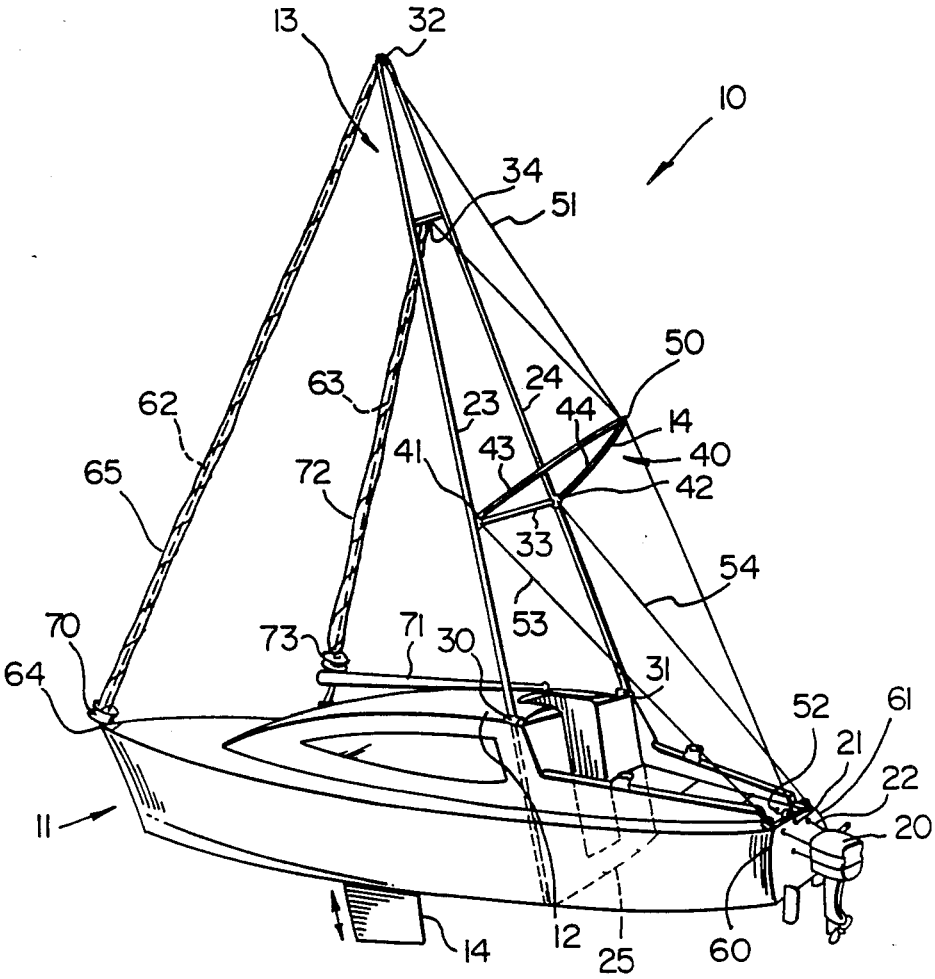
FIG. 1 is an isometric view of an A-frame masted sailing boat according to the invention showing the sails furled.

Referring now to the drawings, a sailing boat is generally illustrated at 10 in FIG. 1. It comprises a hull generally shown at 11, a cabin 12 connected to the hull and an A-frame mast generally shown at 13.

The hull 11 has a keel 14 connected thereto, the keel 14 being raised or lowerd by hydraulic cylinders (not shown). A motor 20 is mounted to the transom or stern 21 of the hull 11 by the use of a bracket 22, described in more detail hereafter.

Figure 2:
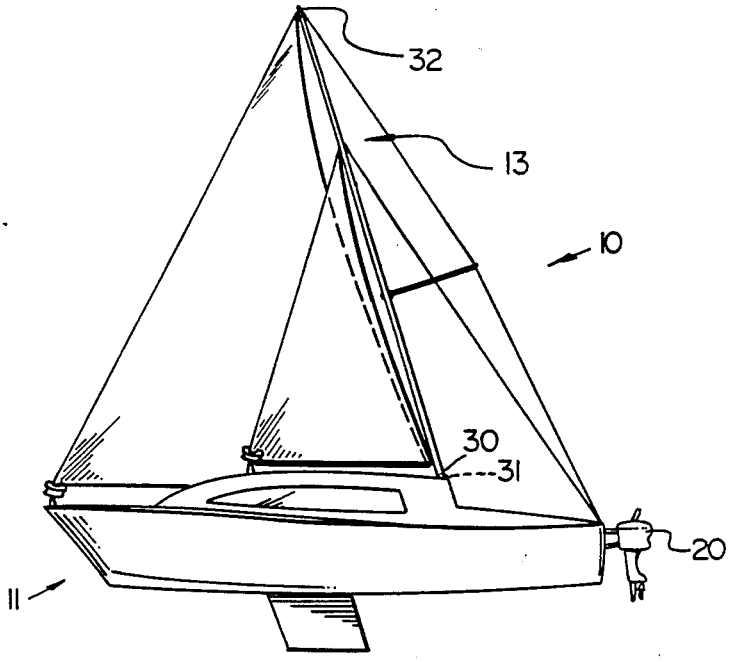
FIG. 2 is a side view of the boat of FIG. 1 showing the sails unfurled.
Figure 3:
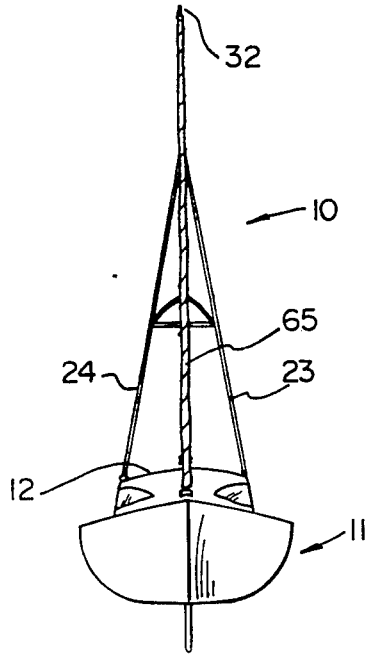
FIG. 3 is a front view of the boat of FIG. 1.

The mast 13 comprises two generally upstanding legs 23, 24, each leg of which is stepped to the topside of the cabin 12 above a rearwardly located bulkhead 25 by pivoted connections 30, 31, respectively. Each leg 23, 24 runs from its respective pivoted connection 30, 31 upwardly until the two legs meet at the apex 32. As more clearly illustrated in FIG. 2, the mast 13 slopes forwardly from the pivoted connections 30, 31 when seen from the side to the apex 32.

Figure 4:
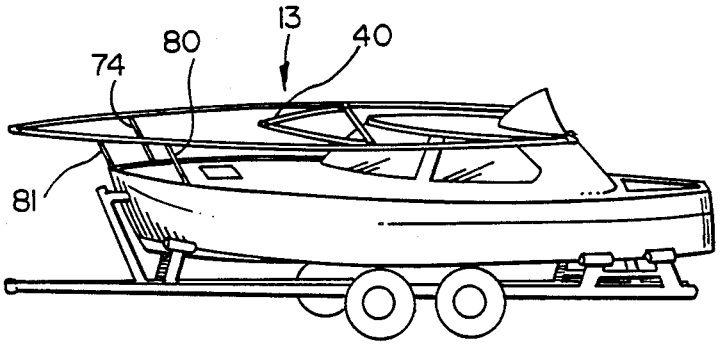
FIG. 4 is an isometric view of the boat according to the invention illustrated in its transportable trailer mode.

A lower and upper brace 33, 34, respectively, are connected between the legs 23, 24 of the mast 13. The lower brace 33 is located such that the brace 33 will not interfere with the roof of the cabin 12 when the mast 13 is lowered to its transport position as illustrated in FIG. 4.

A jumper frame 40 is pivoted at connections 41, 42 and extends rearwardly from the legs 23, 24 of the mast 13 adjacent the lower brace 33. The jumper frame 40 is in the form of a triangle with the lower brace 33 forming its base and the two sides 43, 44 meeting at the apex 50. A main back stay 51 extends from the apex 32 of the mast 13 to the apex 50 of the jumper frame 40 and thence to the centre of the stern 21 where it is connected to a winch 52.

Two lower back stays 53, 54 are each connected to the junction between the lower brace 33 and the legs 23, 24 of the mast 13. They each extend rearwardly and are each attached to the outward edges 60, 61 of the stern 21.

Two forestays 62, 63 are used on the forward side of the mast 13. The forewardmost forestay 62 extends between the apex 32 of the mast 13 and the bow 64 of the boat 10. The rearwardly located forestay 63 extends from the centre of the upper brace 34 to the topside of the cabin 12. The two forestays 62, 63 are substantially parallel as more clearly seen in FIG. 2 and as will be described more specifically hereafter.

A jib 65 is mounted to the forestay 62. It is a furling jib and may be wound about the forestay 62 by using roller 70 connected to the forestay 62. A club footed boom 71 is connected to a rearward forestay 63 and a mainsail 72 is connected to the boom 71 and the rearward forestay 63. The mainsail is a furling type sail and may be wound around the forestay 63 by using roller 73 as illustrated in FIG. 1.

Figure 6A:
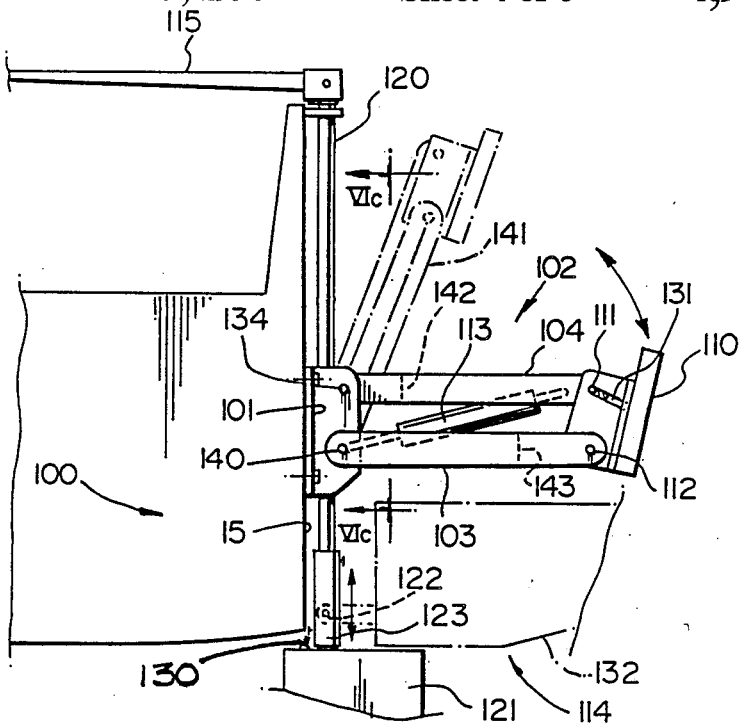
FIG. 6A is an enlayed partial side view of the motor mount and rudder assembly mounted on the transom according to the invention.

Referring not to FIG. 6A, a motor mount assembly is generally shown at 100. It comprises a bracket 101, a link assembly generally illustrated at 102 which comprises first and second parallel links 103, 104, respectively, each of which is a U-shaped channel member as better seen in FIG. 6C. The link assembly 102 is pivotably connected to bracket 101 and a motor clamping block 110 is pivotably connected to the links 103, 104 at pin connections 111, 112. An adjustment apparatus in the form of hydraulic cylinder 113 is connected between the links 103, 104.

The rudder assembly is generally illustrated at 114. It comprises a tiller 115, a rudder shaft 120 and a rudder 121 hingedly connected to the rudder shaft 120 by pin and hinge connection 122 best seen in FIG. 6D. A sleeve 123 is axially moveable on the rudder shaft 120 as indicated by the arrow. A lanyard 125 is connected to the sleeve 123 and extends to the cockpit of the vessel. A spring 130 retains the sleeve 123 in its lower position when the lanyard 125 is not acting on the sleeve 123 and, in this position, the rudder 121 is in its downwardly or operating position.

Figure 6B:
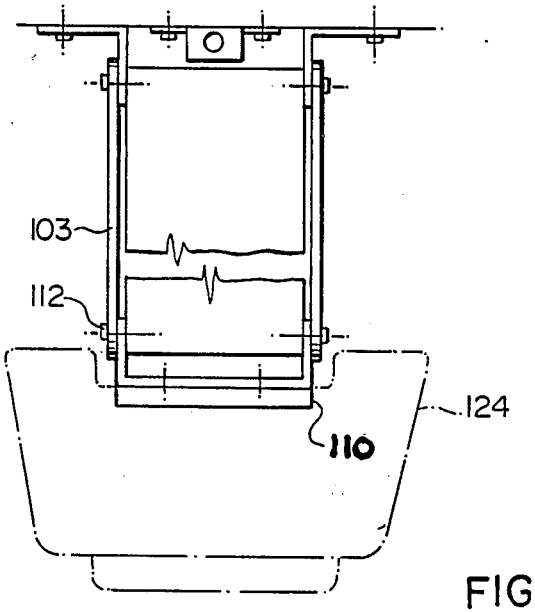
FIG. 6B is a partial plan view of the motor mount and rudder assembly of FIG. 6A showing a motor attached by the broken lines.

The motor 124, shown in phantom in FIG. 6B is connected to the motor clamping block 110. A tilt adjustment 131 (FIG. 6A) in the form of a hydraulic cylinder is provided between the motor clamping block 110 and the pin connection 111.

OPERATION

In operation, it will be assumed that the boat 10 is in the condition illustrated in FIG. 1. That is, the jib 65 and mainsail 72 are in their furled condition, and that it is desired to lower the mast 13.

The two lower back stays 53, 54 are disconnected from their connections 60, 61 at the outward sides of the stern 21 and the boom 71 of the mainsail 72 is also removed. A winch 52 is then operated which allows the main backstay 51 to lower the mast 13. As the mast is lowered, the furled jib and mainsail 65, 72, respectively are gathered onto the deck of the hull 11. Supports 74, 80, 81 (FIG. 4) are used under the mast 13 and keep it in a generally horizontal position as illustrated in FIG. 4. The keel 14 is raised by a hydraulic cylinder (not shown). When the mast 13 has reached its lowered position, the forestays 62, 63 are removed and the jumper frame 40 is also lowered so that it is parallel with the mast 13. The main backstay 51, the jumper stay 82 (when used, see below) and the lower backstays 53, 54 are removed so that the boat 10 is ready for transport as seen in FIG. 4 or operation as a power boat without the mast 13 and keel 14.

It will be assumed the rudder and motor mount assemblies 100, 114 are in their operating mode as illustrated in FIG. 6A. To move the rudder assembly 114 and the motor mount assembly 100 to the transport mode, the lanyard 125 (FIG. 6D) is pulled and the sleeve 123 moves upwardly relative to the rudder shaft 120 to the position illustrated so as to expose the pin connection 122. Under sail, of course, the force of the water would rotate the rudder 121 from its extended position illustrated to the normal position 132 illustrated in FIG. 6A by the dotted lines when the sleeve 123 is moved vertically. Where the vessel is out of the water, however, the rudder 121 is simply manually rotated upwardly until the position illustrated by the broken lines is reached in FIG. 6A. In this position, the sleeve 123 exerts pressure on the rudder extension 133 and maintains it in the normal position indicated in the broken lines of FIG. 6A.

The links 103, 104, being initially generally horizontal and maintained as such by hydraulic cylinder 113, are then rotated about pins 134, 140 by closing hydraulic cylinder 113. The links 103, 104, being in the form of U-channel sections, nestle together as the links move upwardly to the non-operating position as shown by the broken lines 141. The tiller 115 and rudder shaft 120 are then rotated 90° from the position illustrated by the broken lines 132 in FIG. 6A such that the rudder 121 is flush against the transom 15.

When it is desired to move the engine 124, the motor mount assembly 100 and the rudder 121 to the operating position, the procedure above is simply reversed.

Figure 6C:
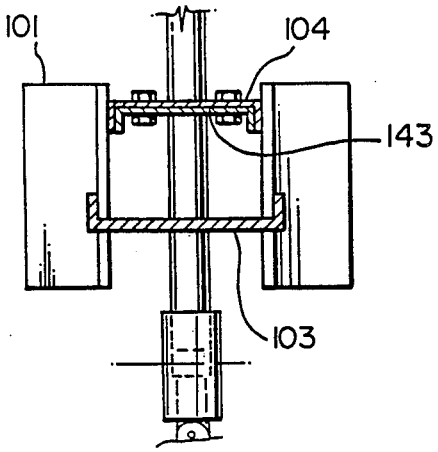
FIG. 6C is a view taken along line VIC—VIC of FIG. 6A.
Figure 6D:
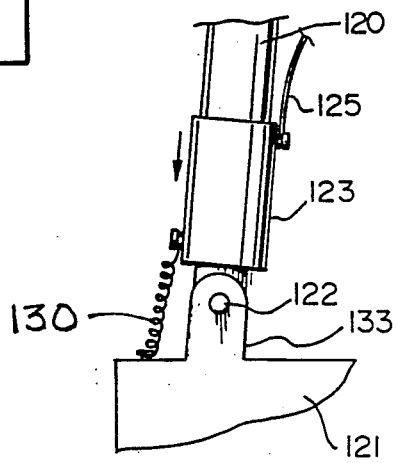
FIG. 6D is an enlarged view of the connection between the rudder and rudder shaft.

It may be desired to increase or decrease the length of the link assembly 102. In this event, connecting link members 142, 143 are provided which telescope into the link members 103, 104, as seen in FIG. 6C. The combination is used to lengthen the distance of the link 102 between the bracket 101 and the motor clamping block 110. Thus, the motor 124 can be adjusted to its optimum operating position both vertically and longitudinally according to the adjustment provided in the motor mount assembly 100.

Figure 5A:
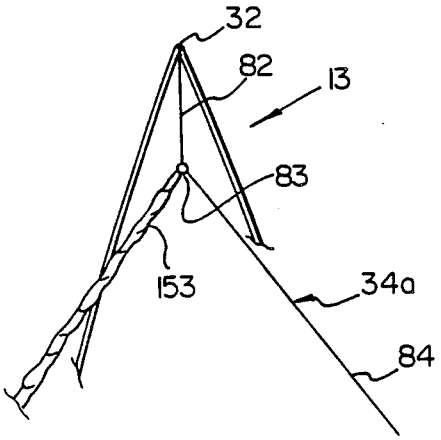
FIGS. 5A and 5B are partial rear views of the A-frame mast illustrating different embodiments of the stay tensioning system.
Figure 5B:
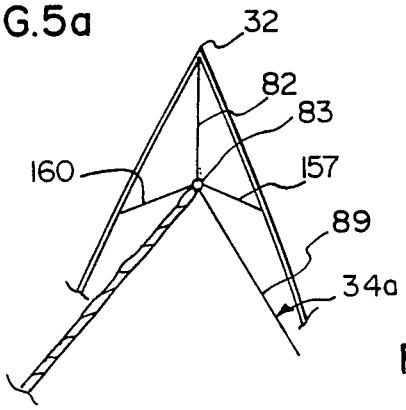

Referring to FIGS. 5A and 5B, two different embodiments of the stay bracing for the mast 13 are illustrated which reduce the bending moment on the mast 13. Referring initially to FIG. 5A, the upper brace on freestay 34 is removed and replaced with a stay extending downwardly from the apex 32 of mast 13 and a stay connection 83 at the termination point of the stay 82. An intermediate backstay 84 extends to the apex 30 of the jumper frame 40 and thence to the transom 15. The furling mainsail stay 153 extends from the stay connection 83 to the end of the top of the cabin 12 as illustrated in FIG. 1. Referring to FIG. 5B, the mainsail stay 153 and the intermediate backstay are as illustrated in FIG. 5A. However, two lateral stays 157, 160 are provided which extend from the stay connection 83 to the mast 13. The stay connection 83 may be moved as desired on stay 82 and intermediate backstay 84 to increase or decrease the leading edge angle of the mainsail 72.

Figure 7A:
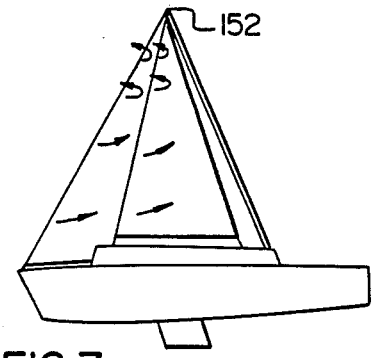
FIGS. 7A, 7B and 7C illustrate further embodiments of the mast design according to the invention.
Figure 7B:
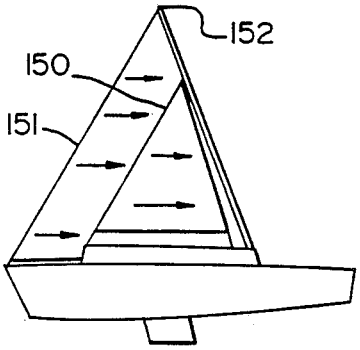

Referring to FIGS. 7A and 7B, the comparison between the parallel stay sail system and the non-parallel sail system is more clearly illustrated. The mainsail stay 150 and the jib stay 151 are parallel in FIG. 7B. This parallel stay system contributes to smooth airflow over the sails and better performance. Utilizing a triangular or non-parallel stay system as illustrated in FIG. 7A results in a restricted airflow and increased turbulence particularly as the stay approach the apex 152 of the mast.

Figure 7C:
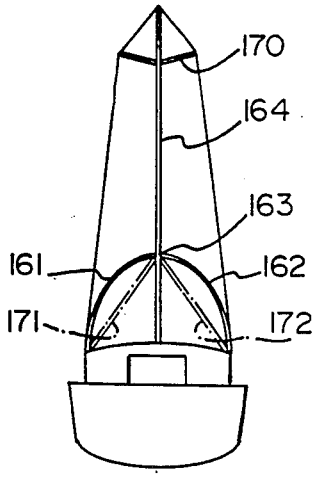

A further embodiment of the mast system is illustrated in FIG. 7C. In this system, a U-section is utilized which comprises two legs 161, 162 which join together at apex 163. The top member 164 of the mast extends upwardly from the apex 163 and a spreader 170 extends from the top member 164 as illustrated. Otherwise, the system is identical to the embodiment illustrated in FIG. 1.

A further embodiment, again illustrated in the broken lines of FIG. 7C, utilizes two straight legs 171, 172 which also join at apex 163. Otherwise, the system is identical to the system designed with the U-sections 161, 162.

Figure 8:
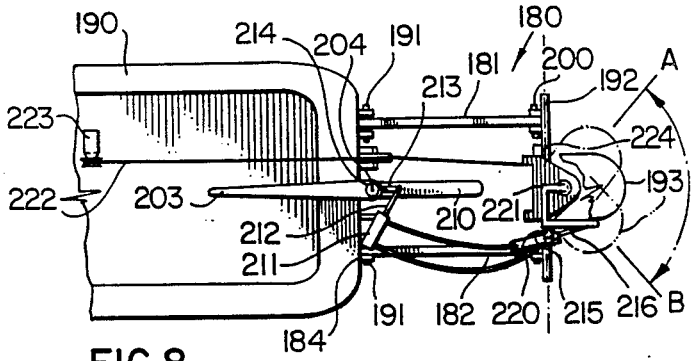
FIG. 8 is a plan view of a further embodiment of the motor mount.

Yet a further embodiment of the motor mount is illustrated in FIG. 8, 9A, 9B. In this embodiment, the motor mount is generally illustrated at 180 in FIG. 8. It comprises a first pair of upper links 181, 182 and a second pair or lower links 183 (only one of which is shown). The links 181, 182, 183 are separated a distance sufficient to allow a rudder 210 to move vertically between the links 181,182,183 and are rotatably mounted to the transom 184 of a boat generally illustrated at 190 about a generally horizontal first axis 191. The links 181,182,183 are rotatable about horizontal axes 191, 195, 200, 205 and extend outwardly from the transom 184 to a motor holding bracket 192 on which an outboard motor 193 is mounted. The motor holding bracket 192 is mounted on the distaff end of the links 181,182,183. The motor 193 is mounted to a first generally vertical axis in the form of a shaft and sleeve (not shown) which sleeve is connected directly to the motor holding bracket 192.

A tiller 203 is rotatably mounted to the transom as is known about a generally vertical second axis 204. The rudder 210 is connected to the tiller 203 also as is known. A hydraulic cylinder 211 is mounted to the transom 184 and the cylinder rod 212 is connected to an arm 213 extending from the shaft 214 of the rudder 210. A second hydraulic cylinder 215 with an attached rod 216 extending therefrom is connected in series with the first cylinder 211 such that as the tiller 203 is turned, for example, clockwise about axis 204, the rod 212 of cylinder 211 will retract which, in turn, will contract rod 216.

Cylinder 215 is connected to a trunnion 220 which is inserted in the usual motor mount steering cable sleeve of the outboard motor 193. The trunnion 220 has two degrees of movement, the first being about generally horizontal axis 224 and the second being about generally vertical axis 230. A bell crank 221 is connected at one end of rod 216. The bell crank 221 is connected at the other end to the motor 193 which will, therefore, rotate under the influence of the cylinder 215, rod 216 and bell crank 221 to steer the outboard motor 193.

Figure 9A:
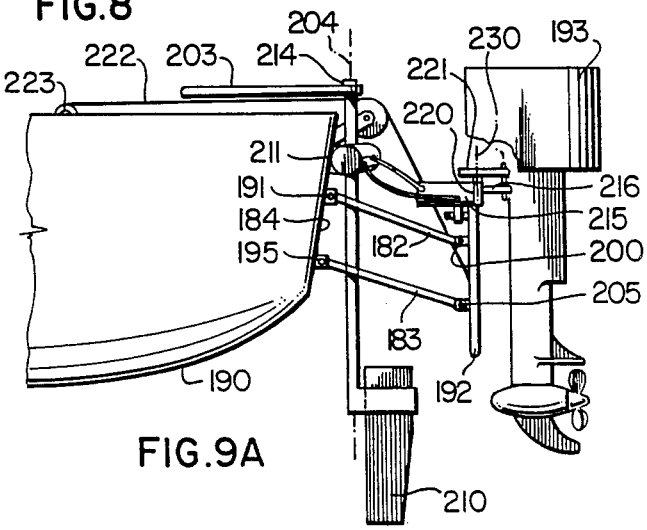
FIGS. 9A and 9B are partial side views of the motor mount of FIG. 8 with the motor shown in both the raised and lowered position.
Figure 9B:
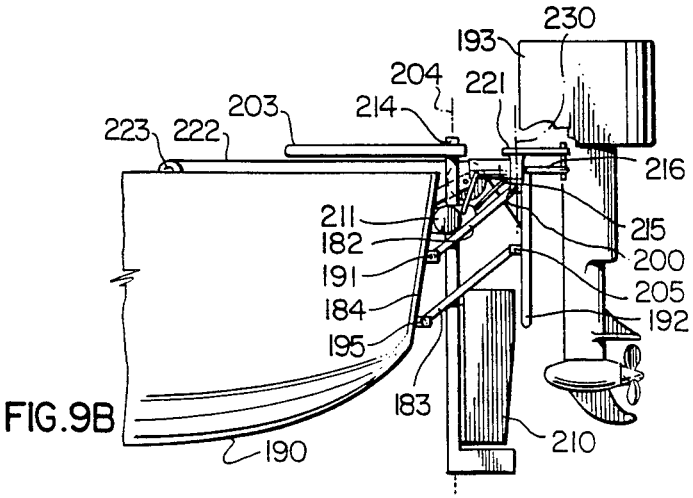

A cable 222 is connected to the motor 193 and this cable extends from the motor 193 to an appropriately located pulley on the transom 184 and will, thereafter, be connected to a winch 223 located within the boat 190. The winch 223 is operable to pull the cable 222 and, therefore, rotate the motor 193 upwardly about horizontal axes 191,200 as seen in FIGS. 9A and 9B and into its generally upper position. The rudder 210 may also be raised within the links 181,182,183 from its lowered position to its upper position. In the upper position, the motor mounting bracket 192 is operable to hold the rudder 210 in its upper or raised position.

With reference to FIG. 1, the cable 222 can also be used as the main backstay 51 or, alternatively, it can be connected to the main backstay 51 to assist in lowering or raising the mast 13. The winch 191, of course, can replace the winch 52 as well as being supplementary to it.

Many further modifications are contemplated to the vessel and motor mount according to the invention which may be made by those skilled in the art. The specific embodiments described should, therefore, be taken as illustrative only and not as limiting the scope of the invention which should be construed in accordance with the accompanying claims.

What is claimed is:

1. A sailing boat comprising a hull, a cabin located on said hull, a mast having two legs, each of said legs extending from a pivotal connection stepped at opposite sides of the aft portion of said hull and joining with the respectively opposite leg of said mast at an apex, a mainsail forestay extending forwardly from said mast, a mainsail connected to said mainsail forestay, said mainsail being located substantially forwardly of said mast, a boom for said mainsail extending rearwardly from said mainsail forestay, said boom having a first end connected to said mainsail forestay and being pivotable about said first end, said mainsail boom being located substantially forwardly of said mast, said mast being operable to slope forwardly from and to rotate about said pivotal connections to a substantially horizontal position, and at least one backstay extending from said mast to the stern of said boat.

2. A sailing boat as in claim 1 and further comprising a first brace operable to be mounted substantially horizontal between said legs of said mast.

3. A sailing boat as in claim 2 wherein each of said legs is substantially straight from said pivotal connection to said apex.

4. A sailing boat as in claim 3 and further comprising a jib operable to be mounted on a jib forestay extending from said mast to the forward area of said boat.

5. A sailing boat as in claim 4 wherein said jib forestay is operable to extend from the apex of said mast to the bow of the boat.

6. A sailing boat as in claim 5 wherein said jib and said mainsail are roller furling sails.

7. A sailing boat as in claim 1 wherein each of said pivotal connections is mounted topside of said cabin above said bulkhead.

8. A sailing boat as in claim 1 and further comprising a stay extending from said apex to a stay connection and a backstay extending from said stay connection rearwardly of said mast.

9. A sailing boat as in claim 7 and further comprising mainsail stay connected to said stay connection.

10. A sailing boat as in claim 9 wherein said stay connection is movable relative to said stay extending from said apex and said backstay.

11. A sailing boat comprising a hull, a cabin located on said hull, a mast having two legs, each of said legs extending from a pivotal connection stepped at opposite sides of the aft portion of said hull and joining with the respectively opposite leg of said mast at an apex, a central leg extending upwardly from said apex to an end portion, a mainsail forestay connected to said central leg and extending forwardly from said mast, a mainsail connected to said mainsail forestay, said mainsail being located substantially forwardly of said mast, a boom for said mainsail extending rearwardly from said mainsail forestay and being located substantially forwardly of said mast, said mast being operable to slope forwardly from and to rotate about said pivotal connections to a substantially horizontal position, and at least one backstay extending from said central leg to the stern of said boat.

12. A sailing boat as in claim 11 and further comprising a brace operable to extend substantially horizontal and between said legs of said mast and lower back stays operable to be connected adjacent the ends of such brace, each of said lower back stays being operable to extend and be connected to the stern of said boat.

13. A sailing boat as in claim 12 and further comprising a jumper frame operable to be pivotably connected adjacent to the lower brace of said mast, the arms of said jumper frame extending rearwardly and joining at an apex, said backstay extending to the apex of said jumper frame in a first interim portion and from the apex to stern of said boat in a second interim portion.

14. A sailing boat as in claim 12 and further comprising a keel extending from said hull, said keel being operable to be raised or lowered with respect to said hull.

* * * * *